US005160655A

United States Patent [19]

Donker et al.

[11] Patent Number: 5,160,655

[45] Date of Patent: Nov. 3, 1992

[54] AQUEOUS STRUCTURED LIQUID DETERGENT COMPOSITIONS CONTAINING SELECTED PEROXYGEN BLEACH COMPOUNDS

[75] Inventors: Cornelis B. Donker, Dordrecht, Netherlands; Michael Hull, Helsby, Great Britain; Johannes C. van de Pas, Vlaardingen, Netherlands

[73] Assignee: Lever Brothers Company, Division of Conopco, Inc., New York, N.Y.

[21] Appl. No.: 794,618

[22] Filed: Nov. 15, 1991

Related U.S. Application Data

[63] Continuation of Ser. No. 673,174, Mar. 18, 1991, abandoned, which is a continuation of Ser. No. 479,326, Feb. 13, 1990, abandoned.

[30] Foreign Application Priority Data

Feb. 27, 1989 [EP] European Pat. Off. ..... 89200492.0
Apr. 13, 1989 [GB] United Kingdom ..... 8908412

[51] Int. Cl.[5] ..... C11D 3/395; C11D 7/18; C11D 7/54

[52] U.S. Cl. ..... 252/95; 252/99; 252/100; 252/102; 252/103; 252/174.17; 252/186.26; 252/186.27; 252/186.3; 252/186.31; 252/186.38; 252/186.42; 252/186.43; 252/186.28; 252/186.25

[58] Field of Search ..... 252/95, 99, 103, 186.26, 252/186.27, 186.3, 186.31, 186.38, 186.42, 186.43, 100, 174.17, 102, 186.28, 186.25

[56] References Cited

U.S. PATENT DOCUMENTS

| | | | |
|---|---|---|---|
| 4,530,780 | 7/1985 | van de Pas et al. | 252/528 |
| 4,618,446 | 10/1986 | Haslop et al. | 252/135 |
| 4,642,198 | 2/1987 | Humphreys et al. | 252/94 |
| 4,783,278 | 11/1988 | Sanderson et al. | 252/95 |
| 4,822,510 | 4/1989 | Madison et al. | 252/95 |
| 4,824,592 | 4/1989 | Rerek et al. | 252/95 |
| 4,891,147 | 1/1990 | Gray et al. | 252/104 |
| 4,908,150 | 3/1990 | Hessel et al. | 252/174.12 |

FOREIGN PATENT DOCUMENTS

| | | |
|---|---|---|
| 37184 | 10/1981 | European Pat. Off. . |
| 38101 | 10/1981 | European Pat. Off. . |
| 160342 | 11/1985 | European Pat. Off. . |
| 176124 | 4/1986 | European Pat. Off. . |
| 240481 | 10/1987 | European Pat. Off. . |
| 256343 | 2/1988 | European Pat. Off. . |
| 293040 | 11/1988 | European Pat. Off. . |
| 294904 | 12/1988 | European Pat. Off. . |
| 332294 | 9/1989 | European Pat. Off. . |
| 1080722 | 4/1960 | Fed. Rep. of Germany . |
| 491047 | 7/1970 | Switzerland . |
| 943271 | 12/1963 | United Kingdom . |
| 1002893 | 9/1965 | United Kingdom . |

*Primary Examiner*—W. J. Shine
*Assistant Examiner*—Douglas J. McGinty
*Attorney, Agent, or Firm*—Ronald A. Koatz

[57] ABSTRACT

An aqueous structured liquid detergent composition comprising detergents active materials and a peroxygen bleach compound, said detergent composition showing less than 25%, preferably less than 10%, more preferably less than 5% volume increase while stored at a temperature between 20° and 37° C. for three months after preparation.

19 Claims, No Drawings

AQUEOUS STRUCTURED LIQUID DETERGENT COMPOSITIONS CONTAINING SELECTED PEROXYGEN BLEACH COMPOUNDS

This is a continuation application of Ser. No. 07/673,174, filed Mar. 18, 1991, abandoned, which is a continuation of U.S. Ser. No. 07/479,326, filed Feb. 13, 1990, abandoned.

The present invention relates to liquid detergent compositions which contain a peroxygen bleach compound.

It has been proposed in EP 293 040 and EP 294 904 to incorporate solid, water-soluble peroxygen bleach compounds in liquid detergent compositions. The compositions as disclosed in these patent applications comprise substantial amounts of water miscible solvents for ensuring that the amount of available oxygen dissolved in the liquid phase is not greater than 0.5%. These high amounts of solvents are however sometimes disadvantageous in that they tend to decrease the solid-suspending properties of the detergent composition, because they are believed to prevent the internal structuring of the liquid detergent composition.

It has now surprisingly been found that stable aqueous liquid bleach containing detergent compositions can be formulated, which are structured. These compositions do not need to contain high -structure destabilizing-amounts of solvents for bleach stabilisation. Lower amounts of solvents are especially preferred, because it is believed that the absence of high levels of solvents renders it possible to make detergent-structured compositions having good solid-suspending properties.

Accordingly the present invention relates to an aqueous structured liquid detergent composition comprising one or more detergent active materials and a peroxygen bleach compound, said detergent composition showing less than 25% volume increase, preferably less than 10%, more preferred less than 5% while stored at a temperature of between 20° and 37° C. for three months after preparation.

Preferably the detergent composition comprises less than a structure destabilizing amount, more preferably less than 10% by weight of a water miscible organic solvent.

The present invention is concerned with structured liquid detergent compositions, such structured liquids can be "internally structured" whereby the structure is formed by primary ingredients and/or they can be structured by secondary additives such as certain cross-linked polyacrylates or clays, which can be added as "external structurants" to compositions of the invention.

Such structuring is very well known in the art and may be deliberately brought about to endow properties such as consumer preferred flow properties and/or turbid appearance. Many structured liquids are also capable of suspending particulate solids such as detergency builders and abrasive particles.

Some of the different kinds of active-structuring which are possible are described in the reference H. A. Barnes, "Detergents", Ch.2. in K. Walters (Ed), "Rheometry: Industrial Applications", J. Wiley & Sons, Letchworth 1980. In general, the degree of ordering of such systems increases with increasing surfactant and/or electrolyte concentrations. At very low concentrations, the surfactant can exist as a molecular solution, or as a solution of spherical micelles, both of these being isotropic. With the addition of further surfactant and/or electrolyte, structured (antisotropic) systems can form. They are referred to respectively, by various terms such as rod-micelles, planar lamellar structures, lamellar droplets and liquid crystalline phases. Often, different workers have used different terminology to refer to the structures which are really the same. For instance, in European patent specification EP-A-151 884, lamellar droplets are called "spherulites". The presence and identity of a surfactant structuring system in a liquid may be determined by means known to those skilled in the art for example, optical techniques, various rheometrical measurements, x-ray or neutron diffraction, and sometimes, electron microscopy.

Electrolyte may be only dissolved in the aqueous continuous phase or may also be present as suspended solid particles. Particles of solid materials which are insoluble in the aqueous phase may be suspended alternatively or in addition to any solid electrolyte particles.

Three common product forms in this type are liquids for heavy duty fabrics washing and liquid abrasive and general purpose cleaners. In the first class, the suspended solid can comprise suspended solids which are substantially the same as the dissolved electrolyte, being an excess of same beyond the solubility limit. This solid is usually present as a detergency builder, i.e. to counteract the effects of calcium ion water hardness in the wash. In the second class, the suspended solid usually comprises a particulate abrasive, insoluble in the system. In that case the electrolyte, present to contribute to the structuring of the active material in the dispersed phase, is generally different from the abrasive compounds. In certain cases, the abrasive can however comprise partially soluble salts which dissolve when the product is diluted. In the third class, the structure is usually used for thickening the product to give consumer-preferred flow properties, and sometimes to suspend pigment particles.

Compositions of the first kind are described in for example our patent specification EP-A-38,101 whilst examples of those in the second category are described in our specification EP-104,452. Those in the third category are for example, described in U.S. Pat. No. 4,244,840.

The dispersed structuring phase in these liquids is generally believed to consist of an onion-like configuration comprising concentric bilayers of detergent active molecules, between which is trapped water (aqueous phase). These configurations of active material are sometimes referred to as lamellar droplets. It is believed that the close-packing of these droplets enables the solid materials to be kept in suspension. The lamellar droplets are themselves a sub-set of lamellar structures which are capable of being formed in detergent active/aqueous electrolyte systems. For the purpose of the present invention, detergent compositions of the lamellar droplet type are preferred.

THE PEROXYGEN BLEACH

The compositions according to the present invention comprise a peroxygen bleach. This bleach component may be present in the system in solubilized form, but also possible is that only part of the peroxygen bleach is solubilized, the remaining part being present as solid peroxygen particles which are suspended in the system.

Examples of suitable peroxygen compounds include hydrogen peroxide, the perborates, persulfates, peroxy disulfates, perphosphates and the crystalline peroxyhydrates formed by reacting hydrogen peroxide with urea or alkali metal carbonate. Also encapsulated bleaches may be used. Preferred bleaches are only partially soluble in the system such as for example diperoxydodecandioic acid (DPDA) or other peracid crystals and perboratetetrahydrate. The bleach component is preferably added in an amount corresponding to 0.1 to 15% by weight of active oxygen, more preferred from 0.5 to 5% active oxygen, typically from 1.0 to 3.0% active oxygen.

The bleach ingredients may for example be added to the composition as a dry particulate material or as a predispersion of bleach particles. If perborate-tetrahydrate bleaches are used, a suitable commercial available bleach dispersion is Proxsol (ex ICI), alternatively perborate-tetrahydrate crystals may be formed in-situ for example as described in EP 294 904.

DETERGENT ACTIVE MATERIALS

In the widest definition the detergent active materials in general, may comprise one or more surfactants, and may be selected from anionic, cationic, nonionic, zwitterionic and amphoteric species, and (provided mutually compatible) mixtures thereof. For example, they may be chosen from any of the classes, sub-classes and specific materials described in "Surface Active Agents" Vol. I, by Schwartz & Perry, Interscience 1949 and "Surface Active Agents" Vol. II by Schwartz, Perry & Berch (Interscience 1958), in the current edition of "McCutcheon's Emulsifiers & Detergents" published by the McCutcheon division of Manufacturing Confectioners Company or in Tensid-Taschenburch", H. Stache, 2nd Edn., Carl Hanser Verlag, Munchen & Wien, 1981.

Suitable nonionic surfactants include, in particular, the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Also possible is the use of salting-out resistant active materials, such as for example described in EP 328 177, especially the use of alkyl polyglycoside surfactants, such as for example disclosed in EP 70 074.

Preferably the level of nonionic surfactants is more than 1% by weight of the composition, preferably from 2.0 to 20.0%.

Suitable anionic surfactants are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulponate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Generally the level of the above mentioned non-soap anionic surfactant meterials is from 1–40% by weight of the composition.

Preferably the weight ratio of synthetic anionic surfactants to nonionic surfactants is from 10:1 to 1:10.

It is also possible, and sometimes preferred, to include an alkali metal soap of a mono- or di-carboxylic acid, especially a soap of an acid having from 12 to 18 carbon atoms, for example oleic acid, ricinoleic acid, and fatty acids derived from castor oil, rapeseed oil, groundnut oil, coconut oil, palmkernel oil, alk(en)yl succinates e.g. dodecyl succinates or mixtures thereof. The sodium or potassium soaps of these acids can be used. Preferably the level of soap in compositions of the invention is form 1–40% by weight of the composition, more preferred from 5–25%.

In many (but not all) cases, the total detergent active material may be present at from 2% to 60% by weight of the total composition, for example from 5% to 40% and typically from 10% to 30% by weight. However, one preferred class of compositions comprises at least 20%, most preferably at least 25% and especially at least 30% of detergent active material based on the weight of the total composition.

Compositions according to the invention are preferably physically stable in that they yield no more than 2% by volume phase separation when stored at 25° C. for 21 days from the time of preparation. Especially preferred are compositions which do not yield any phase separation upon storage for 21 days at 25° C.

Compositions according to the invention, preferably have solid-suspending properties in that they yield less than 5% by volume of sediment after storage for 21 at 25° C., more preferably less than 2% by volume sediment is formed, most preferably substantially no visible sediment is formed.

Preferably compositions according to the invention comprise less than a structure destabilising amount of water miscible solvent, preferably less than 10% by weight, for example less than 7.5%, more preferred less than 5%, especially preferred less than 2.0%, typically less than 0.5% by weight of a water miscible solvent.

Depending on the other ingredients of the composition, it is however sometimes possible to incorporate low levels of water miscible solvents, say from 0.1 to 8% by weight, more preferred from 2 to 6%, without the occurence of structure estabilisation. In particular it has been found that these low levels of water miscible solvents may advantageously be used in combination with relatively high levels of dissolved electrolyte, say more than 2% by weight, more preferred more than 5% by weight, especially preferred between 10 and 50% by weight. Bleach containing compositions comprising water miscible solvents at levels which do not prevent the formation of structuring, in particular internal structuring, are also embraced within the scope of the present invention.

Examples of water-miscible solvents are lower aliphatic monoalcohols, ethers of diethylene glycol and lower monoaliphatic monoalcohols, and mixtures thereof.

VOLUME-STABILITY

Liquid detergent compositions according to the invention are volume stable in that they show less than 25% preferably less than 10%, more preferably less than 5% volume increase during storage at a temperature between 20° and 37° C. for a period of three months after preparation.

Although the type of container for storage is believed not to be critical, generally liquid detergent compositions according to the invention will be stored in closed bottles, say of 1.5 litre, which optionally may include venting means, for releasing generated oxygen.

When a solid peroxygen bleach component is present in an aqueous system, generally part of the bleach material will be solubilized in the form of peracid and/or hydrogen peroxide in the aqueous phase. One of the problems often observed in such systems is the occurence of oxygen evolution, due to the decomposition of this peracid or hydrogen peroxide into acid and/or water and oxygen. The oxygen bubbles formed may either emerge from the liquid or be trapped in the liquid, thereby causing a volume increase. A similar oxygen evolution is observed when the bleach component such as for instance hydrogen peroxide is totally solubilized in the system.

The present invention provides liquid detergent compositions wherein the volume increase is kept at an acceptable level of less than 25%, preferably less than 10% , more preferred less than 5%. during storage of the composition at a temperature between 20° and 37° C. for three months after preparation.

The parameters to be varied in the composition to bring about the desired volume stability effect may for example be the pH, the physical state of the undissolved bleach particles when present, the amount of dissolved bleach, the presence of stabilising agents, the amount of dissolved bleach activators, the viscosity of the product directly after preparation, the presence of viscosity reducing polymers, the presence of gas bubbles in the composition directly after preparation and the presence of antifoam agents. The choice of an optimum value of these parameters is dependant on the nature and the choice of the active materials which are present in the composition.

The half life time of the solubilized peracid or hydrogen peroxide should preferably be increased for increasing the volume stability of the composition. Not only the amount of oxygen formed per time unit is less by increasing the stability of the peracid or hydrogen peroxide, also—and this has been found more important—an increase in the life time of these compounds will allow the oxygen bubbles to be formed upon decomposition of the peracid or hydrogen peroxide to grow in size. An increase in the size of the bubbles to be formed is considered advantageous in that these larger bubbles have been found to be less prone to contribute to the volume increase of the liquid detergent composition, in other words they tend to escape from the liquid rather than being suspended into the system.

Preferably the half-life time of the hydrogen peroxide or peracid is more than 3 weeks, preferably more than 6 weeks at 37° C. at the conditions in the detergent composition, preferably more than 8 weeks, especially preferred more than 10 weeks. Most preferred is between 10 and 20 weeks.

The stability of the peracid or hydrogen peroxide may be increased in several ways such as for instance a decrease in pH of the composition. It has been found that the volume stability of the liquid detergent composition increases by decreasing the pH of the composition. Therefore, for the purpose of formulating volume stable compositions it is preferred to avoid the use of excessive high pH values. Preferably the pH of the detergent compositions is less than 12, more preferred less than 11.5, especially preferred between 6.5 and 11, typically from 7 to 10.

It has also been found that the volume stability of the detergent compositions according to the present invention can be improved by using bleach particles which are encapsulated. These encapsulated bleach particles constitute part or all of the bleach present in the composition, the particles are mainly present in the composition in undissolved form.

The presence of bleach particles in undissolved form is also preferred when the bleach particles are not encapsulated. Higher levels of undissolved bleach are preferred, because it is believed that bleach instability is mainly instability of dissolved bleach. Preferably at least 10% by weight, more preferably at least 30%, especially preferred more than 50%, most preferably more than 75% or even more than 90% by weight of the bleach is present in undissolved form. If perborate bleaches are used it has been found that the amount of dissolved bleach is reduced if the pH of the composition is relatively high say from 7–11, more preferably from 7.5 to 10.

Preferably the weight average diameter of the undissolved bleach particles is from 0.5 to 100 micrometer, especially 5 to 60 micrometer. A method for obtaining these small particles is described in EP 294 904.

One way of ensuring that the bleach is present in undissolved form is to increase the amount of electrolyte in the composition, therewith reducing the solubility of the bleach component in the system. Suitable electrolytes for this purpose are for instance the at least partially water soluble carbonate, sulphate and halogenide salts and metaborate. Other preferred electrolytes are salting out electrolytes.

For the purpose of the present invention the expression salting out electrolyte has the same meaning as in EP 79 646, namely those electrolytes which have a lyotropic number of less than 9.5.

Typical examples of salting out electrolytes are water-soluble builder salts, such as alkali metal ortho- and pyroposphates, the alkali metal tripolyphosphates, such as sodium tripolyposphate, the alkali metal silicates, -borates, -carbonates, -sulphates, alkali metal citrates; alkali metal salts of nitriloacetate; alkali metal salts of carboxymethoxy succinate. Instead of the alkali metal salts the ammonium salts can be used. Particularly preferred is the use of sodium tripolyphosphate and or sodium (di)silicate as the salting out electrolyte.

For ensuring an adequate reduction in solubility of the bleach component, the dissolved part of the electrolyte constitutes preferably more than 2% by weight of the composition, more preferred more than 5% by weight, especially preferred between 10 and 50% by weight.

For obtaining good volume stability, preferably the compositions according to the present invention also comprise a stabilising agent for the bleach component. Suitable stabilisers are well-known in art and include EDTA, Magnesium silicates and phosphonates such as for instance the Dequest range ex Monsanto and Naphthol ex Merck. Preferably the amount of stabilising agent is from 0.05 to 5% by weight of the composition, more preferred from 0.05 to 1% of the composition.

Compositions of the present invention may comprise one or more bleach activator agents. These materials when combined with a peroxy bleach in the wash, will activate hydrogen peroxide at a low temperature of from 15° to 55° C. therewith allowing the effective use of peroxide bleaches at low washing temperatures.

The bleach activators used in the present invention, often also referred to as peroxyacid bleach precursors are conventionally organic compounds having one or more reactive acyl groups, which at relatively low temperature react with hydrogenperoxide causing the formation of organic peroxyacids, the latter providing for a more effective bleaching action at lower temperatures than hydrogen peroxide itself.

The best known organic bleach activator of practical importance is N,N,N,N'-tetraacyl ethylene diamine, normally referred to as TAED. Another well-known bleach activator is sodium-4-benzoyl oxybenzene sulphonate normally referred to as BOBS, as disclosed in GB 836,988.

Examples of other organic bleach activators are other n-acyl substituted amides, for example tetraacetyl methylene diamine; carboxylic acid anhydrides for example succinic, benzoic and phthalic anhydrides; carboxylic acid esters, for example sodium acetoxy benzene sulphonate; acetates such as glycerol-triacetate, glucose pentaactetate and xylose-tetraacetate and acetyl salicylic acid.

Preferably TAED is used as the bleach activator. The preferred level of bleach activator in the liquid detergent is from 0.1 to 10% by weight preferably from 0.5 to 5% by weight of the composition.

Preferably the bleach activator is present in the system in at least partly undissolved form. Preferably at least 10% by weight, more preferably at least 30%, especially preferred more than 50% by weight of the activator is present in undissolved form.

One way of ensuring that the activator is present in undissolved form is the use of encapsulated activator materials. Another method is to increase the amount of electrolyte in the composition, therewith reducing the solubility of the activator in the system. Suitable electrolytes for this purpose are for instance the at least partially water soluble carbonate, sulphate and halogenide salts and metaborate. Other preferred electrolytes are salting out electrolytes as defined hereabove.

For ensuring an adequate reduction in solubility, the dissolved part of the electrolyte constitutes preferably more than 2% by weight of the composition, more preferred more than 5% by weight, especially preferred between 10 and 50% by weight.

As to the viscosity of the product directly after preparation, it has been found that a lower value for the viscosity generally increases the volume stability of the bleach containing product. Also for lower viscosities are genrally preferred by the consumer. However, for providing solid-suspending properties, low viscosities should preferably be avoided. Therefore in selecting the most appropriate viscosity of the product, a balance should be sought between better stability and consumer-acceptance at lower viscosities and increased solid suspending properties at higher viscosities.

Generally it is preferred that for good volume stability and good consumer-acceptance, the viscosity is preferably less than 2,000 mPas at 21 $s^{-1}$, more preferred less than 1,500, most preferred between 20 and 1,000, especially preferred from 30 to 500. For good solid suspending properties, it is preferred that the viscosity is more than 1,000 mPas at $10^{-4}s^{-1}$, more preferred more than 10,000, especially preferred more than 100,000.

The techniques for obtaining the initial viscosity as desired are well-known in the art, and include for example the appropriate choice of active ingredients, the adaptation of the level of dissolved electrolyte and the inclusion of viscosity modifying agents. A preferred way for regulating the viscosity of the product is the inclusion of polymers in the composition.

Viscosity and/or stability regulating polymers which are preferred for incorporation in compositions according to the invention include deflocculating polymers e.g. those having a hydrophilic backbone and at least one hydrophobic side chain. Such polymers are described in our copending British patent applications 8813978.7 (corresponding to EP 346 995), 8924479.2, 8924478.4 and 8924477.6 and in U.S. Ser. No. 664,513 to Kaiserman et al, now U.S. Pat. No. 5,071,586.

Other polymers which could advantageously be used for viscosity regulation are described in EP 301,882 (Unilever PLC) and EP 301,883 (Unilever PLC). Preferably the amount of viscosity regulating polymer, especially deflocculating polymers, is from 0.1 to 5% by weight of the total composition, more preferred from 0.2 to 2%.

As to the presence of gas bubbles in the detergent composition according to the invention, it has been found that both the size and the level of gas bubbles are important parameters for determining the volume stability of the composition. Generally gas bubbles in the form of air or oxygen bubbles are introduced into liquid detergent compositions during processing of the composition, which usually involves a mixing stage.

It has been found that it is generally preferred to reduce the amount of gas which is present in the composition just after preparation. Preferably the volume fraction of gas bubbles is less than 5.0%, preferably less than 3.5%, most preferred less than 2.0%, especially less than 1% or even less than 0.5%.

It has also been found that when gas bubbles are present, the volume stability of the liquid detergent composition increases when at constant gas content the average diameter of the gas bubbles in increased.

Preferably the average diameter of the gas bubbles is above 0.25 mm, more preferred above 0.4 mm, most preferred above 0.5 mm.

Several techniques can be used for reducing the amount of gas bubbles and for increasing the size of the gas bubbles.

For example the presence of an antifoam agent both reduces the volume fraction of gas bubbles and increases the size of the bubbles present. Preferably the antifoam agents are added at a level above the level commonly used for foam reduction of detergent compositions. Preferably the level of antifoam agent is more than 0.2% of the detergent composition, more preferred more than 0.3% of the composition, especially preferred from 0.4 to 2.0% of the composition. Suitable antifoam agents include silicone antifoam agents, such as dimethyl polysiloxanes and/or silica particles.

Furthermore it has been found that the use of lower shear-rates in the mixing of the detergent compositions of the invention, decreases the amount of gas bubbles in the composition. A similar decrease can be observed when mixing the detergent composition under deaerated conditions, by centrifuging the detergent composition after mixing, by leading a stream of large gas bubbles through the composition during or after mixing and by vacuum deaeration of the product after mixing. Especially preferred for obtaining the desired result is the centrifuging of the composition in the absence of suspended solids and/or the vacuum deaeration of the composition.

It should be noted that the choice of the values of the optimum set of values of the above mentioned parameters should be determined for each detergent composition individually while using the above given guidelines. For certain compositions it may not be necessary to optimise all of the above given parameters. For instance for some detergent compositions it may appear that if the amount and size of the gas bubbles present in the composition is adequately controlled, then a greater flexibility in choosing the viscosity and or pH of the system may be obtained, while still resulting in compositions satisfying the required stability requirement. It is however believed to be well within the ability of a skilled man on the basis of the above teaching to determine for each detergent composition an acceptable set of values for the above-mentioned parameters.

OPTIONAL INGREDIENTS

When the compositions are of lamellar structure then in many cases it is preferred for the aqueous continuous phase to contain dissolved electrolyte. As used herein, the term electrolyte means any ionic water soluble material. However, in lamellar dispersions, not all the electrolyte is necessarily dissolved but may be suspended as particles of solid because the total electrolyte concentration of the liquid is higher than the solubility limit of the electrolyte. Mixtures of electrolytes also may be used, with one or more of the electrolytes being in the dissolved aqueous phase and one or more being substantially only in the suspended solid phase. Two or more electrolytes may also be distributed approximately proportionally, between these two phases. In part, this may depend on processing, e.g. the order of addition of components. On the other hand, the term "salts" includes all organic and inorganic materials which may be included, other than surfactants and water, whether or not they are ionic, and this term encompasses the sub-set of the electrolytes (water soluble materials).

The only restriction on the total amount of detergent active material and electrolyte (if any) is that in the lamellar compositions embraced in the present invention, together they must result in formation of an aqueous lamellar dispersion. Thus, within the ambit of the present invention, a very wide variation in surfactant types and levels is possible. The selection of surfactant types and their proportions, in order to obtain a physically stable liquid with the required structure will be fully within the capability of those skilled in the art. However, it can be mentioned that an important subclass of useful compositions is those where the detergent active material comprises blends of different surfactant types. Typical blends useful for fabric washing compositions include those where the primary surfactant(s) comprise nonionic and/or a non-alkoxylated anionic and/or an alkoxylated anionic surfactant.

In the case of blends of surfactants, the precise proportions of each component which will result in such physical stability and viscosity will depend on the type(s) and amount(s) of the electrolytes, as is the case with conventional structured liquids.

The compositions optionally also contain electrolyte in an amount sufficient to bring about structuring of the detergent active material. Preferably though, the compositions contain from 1% to 60%, especially from 10 to 45% of a salting-out electrolyte. Salting-out electrolyte has the meaning ascribed to in specification EP-A-79 646. Optionally, some salting-in electrolyte (as defined in the latter specification) may also be included, provided it is of a kind and in an amount compatible with the other components and the composition is still in accordance with the definition of the invention claimed herein. Some or all of the electrolyte (whether salting-in or salting-out), or any substantially water insoluble salt which may be present, may have detergency builder properties.

In any event, it is preferred that compositions according to the present invention include detergency builder material, some or all of which may be electrolyte. The builder material is any material capable of reducing the level of free calcium ions in the wash liquor and will preferably provide the composition with other beneficial properties such as the generation of an alkaline pH, the suspension of soil removed from the fabric.

Examples of phosphorous-containing inorganic detergency builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates. Phosphonate sequestrant builders may also be used. Sometimes, however, it is preferred to minimise the amount of phosphorous-containing builders.

Examples of non-phosphorus-containing inorganic detergency builders, when present, include water-soluble alkali metal carbonates, bicarbonates, silicates and crystalline and amorphous aluminosilicates. Specific examples include sodium carbonate (with or without calcite seeds), potassium carbonate, sodium and potassium bicarbonates, silicates and zeolites.

Examples of organic detergency builders, when present, include the alkaline metal, ammonium and substituted ammonium polyacetates, carboxylates, polycarboxylates, polyacetyl carboxylates and polyhydroxysuphonates. Specific examples include sodium, potassium, lithium, ammonium and substituted ammonium salts of ethylenediaminetetraacetic acid, nitrilitriacetic acid, oxydisuccinic acid, melitic acid, benzene polycarboxylic acids, CMOS, tartrate mono succinate, tartrate di succinate and citric acid.

In the context of organic builders, it is also desirable to incorporate polymers which are only partly dissolved, in the aqueous continuous phase as described in EP 301.882. This allows a viscosity reduction (due to the polymer which is dissolved) whilst incorporating a sufficiently high amount to achieve a secondary benefit, especially building, because the part which is not dissolved does not bring about the instability that would occur if substantially all were dissolved.

It is further possible to include in the compositions of the present invention, alternatively, or in addition to the partly dissolved polymer, yet another polymer which is substantially totally soluble in the aqueous phase and has an electrolyte resistance of more than 5 grams sodium nitrilotriacetate in 100 ml of a 5% by weight aqueous solution of the polymer, said second polymer also having a vapour pressure in 20% aqueous solution, equal to or less than the vapour pressure of a reference 2% by weight or greater aqueous solution of polyethylene glycol having an average molecular weight of 6000; said second polymer having a molecular weight of at least 1000. Use of such polymers is generally described in our EP 301,883.

Preferably the level of non-soap builder material is from 5-50% by weight of the composition, more preferred from 5 to 35%.

Although it is possible to incorporate minor amounts, of hydrotropes other than water-miscible solvents, we prefer that the compositions of the present invention contain low levels or are substantially free from hydrotropes. By hydrotrope is meant any water soluble agent which tends to enhance the solubility of surfactants in aqueous solution.

Apart from the ingredients already mentioned, a number of optional ingredients may also be present, for example lather boosters such as alkanolamides, particularly the monoethanolamides derived from palm kernel fatty acids and coconut fatty acids, fabric softeners such as clays, amines and amine oxides, lather depressants, inorganic salts such as sodium sulphate, and, usually present in very minor amounts, fluorescent agents, perfumes, enzymes such as proteases, amylases and lipases (including Lipolase (Trade Mark) ex Novo), germicides and colourants.

Compositions of the invention may be prepared by any conventional method for the preparation of liquid detergent compositions. A preferred method involves the dispersing of the electrolyte (non-builder)—if any—together with the minor ingredients except for the temperature sensitive ingredients—if any—in water of elevated temperature, followed by the addition of the builder material—if any—, the detergent active materials (optionally as a pre-mix) under stirring and thereafter cooling the mixture and adding any temperature sensitive minor ingredients such as enzymes or perfumes and the bleach. The deflocculating polymer—if any—may for example be added after the elctrolyte ingredient or as the final ingredient.

When perborate monohydrate is used as the bleaching agent, it may be preferred to cool the final product to a temperature just above the freezing point, in order to accelerate the recrystallisation of the perborate in tetrahydrate form.

In use the liquid detergent compositions of the invention will generally be diluted with wash water to form a wash liquor, which may be used for detergency purposes, for example for the washing process in a washing machine. The concentration of liquid detergent composition in the wash liquor is preferably from 0.1 to 10% by weight, more preferred from 0.1 to 3%.

The invention will now be illustrated by way of the following Examples. In all Examples, unless stated to the contrary, all percentages are by weight.

EXAMPLE 1

A basic liquid detergent composition of the following composition was prepared by addition under stirring of the components in the order listed. Na-Dobs was formed in-situ by combining NaOH and Dobs-acid. Some of the processing water was left behind because the hydrogen peroxide solution used was 27 weight % active.

TABLE 1

| | % by weight |
|---|---|
| Water | balance |
| Na-Dobs | 13.8 |
| Synperonic 7 | 4.0 |
| Dequest 2060 | 0.1 |
| X-Naphtol | 0.2 |
| STP thermphos NW | 8.6 |
| $H_2O_2$ (100%) | 5.0 |
| ph[1)] | 7.9-8.1 |

TABLE 2a

| Raw material specification | |
|---|---|
| Component | Supplier |
| Dobs-acid (98%), Marlon AS-3 | Hüls |
| Synperonic 7 | I.C.I. |
| Dequest 2060 | Monsanto |
| X-Naphtol, (p.a.) | Merck |
| STP, thermphos NW | Hoechst |
| $H_2O_2$, 27% | Brocacef |

[1)]pH adjusted with NaOH if necessary.

EXAMPLE 2

By varying the Na-Dobs/Synperonic weight ratio and keeping the total amount of actives constant, the basic detergent composition according to example 1 was prepared in several versions of different viscosity direct after preparation.

Composition A has a ratio Na-Dobs to Synperonic of 0.74:0.26 and a viscosity of 170 mPas at 21 $s^{-1}$, composition B had a ratio Na-Dobs to Synperonic of 0.75:0.25 and a viscosity of 390 mPas and composition C had a ratio Na-Dobs to Synperonic of 0.78:0.22 and a viscosity of 1000 mPas. The compositions were stored at 37° C.

Composition A showed in the first two days of storage a slight volume increase of about 2% by volume, after 2 two days the volume decreased to a volume which was about 1% less than the volume of the composition directly after preparation.

Composition B showed a sharp volume increase of about 50% by volume in the first three days of storage, followed by a reduction of the volume until at the 5th day the composition had approximately its original volume.

Composition C showed during the first 7 days a sharp volume increase of more than 125% by volume (overfoam), a reduction of volume to the original volume of the composition was observed after 15 days.

This example illustrates that by lowering the viscosity of the composition, the volume stability of detergent compositions containing solubilized hydrogen peroxide can be increased.

EXAMPLE 3

The composition of example 1 was prepared by the method as indicated in example 1, with some small modifications.

Composition D was prepared according to example 1, the ratio Na-Dobs to Synperonic was 0.77:0.23. Composition E was prepared as composition D, but 0.1% of silicone antifoam was added (corresponding to 0.33% DB31 ex DoW Corning) before mixing the ingredients. Composition F was prepared as composition D, but the composition was deaerated by centrifuging for 5 min at 4000 G. Composition G was prepared as composition D, but 0.33% of DB31 was added and the composition was de-aerated by centrifuging for 5 min at 4000 G. The viscosity of compositions D-G was 860 mPas after preparation. The compositions were stored at room temperature and the volume increase and the bubble size were monitored.

Composition D showed a linear increase in volume up to a maximum of about75% volume increase after 30 days of storage. The diameter of the gas bubbles present during this period showed a similar increase from very small (about 0.1 mm) to about 1.5 mm after 30 days. After 30 days the volume of the compositions decreased gradually until the composition was back at its original volume after 60 days. The bubble diameter stayed constant at a value of 1.5 mm during this period.

Composition E showed a linear increase in volume up to a maximum value of about 55% volume increase after 30 days of storage. The diameter of the gas bubbles present during this period showed a similar increase from very small (around 0.25 mm) to about 1.8 mm after 30 days. After 30 days the volume of the composition decreased gradually until the composition was back at its original volume after about 60 days.

Composition F showed an increase in volume during the first 7 days to a maximum value of about 10% by volume. After 7 days the volume increase decreased to a value of about 0% and remained constant during 60 days of storage. The diameter of the gas bubbles present during this period remained substantially constant at about 1.5 mm.

Composition G did not show a substantial increase in volume during storage for 60 days. The diameter of the gas bubbles present during this period showed an increase from 1 mm to 1.8 mm in the first 10 days of storage, and then remained constant during the remaining of the period.

This example illustrates that both the presence of an antifoam agent and/or the de-aeration of the composition contribute positively to the stability of the liquid detergent composition.

EXAMPLE 4

Compositions were prepared according to example 1, with some small modifications. Composition H was of the composition of example 1, and had a viscosity of between 400 and 600 mPas, Composition I contained in addition to the components of composition H 0.5% by weight of silicone, corresponding to 1.5% by weight of DB 31 which was added at the beginning of the mixing process. For both compositions the amount and the size of the gas bubbles in the liquid detergent just after preparation was measured.

Composition H contained 5.2% by volume of gas bubbles, the size of the bubbles was between 0.1 and 0.2 mm.

Composition I contained 1.9% by volume of gas bubbles, the size of the bubbles was between 0.25 and 0.5 mm.

This examples shows that the amount and size of gas bubbles in the detergent composition can positively be influenced by incorporation of an antifoam agent during processing.

EXAMPLES 5-8

The following compositions were prepared by adding the electrolyte together with the minor ingredients except for the perfume and the enzymes to water of elevated temperature, followed by the addition of the detergent active material as a premix under stirring and thereafter cooling the mixture and adding the enzymes, perfumes and the bleach.

| INGREDIENT (% WT) | 5 | 6 | 7 | 8 |
|---|---|---|---|---|
| Na-Dobs | 21 | 21 | 23.3 | 21 |
| Synperonic 7 | 9 | 9 | 10 | 9 |
| Glycerol | 3.5 | — | 3.9 | — |
| Metaborate | 2.6 | 2.6 | 2.9 | 2.6 |
| Na Citrate/Citric acid[1)] | 9.8 | 9.8 | 11.1 | 9.8 |
| Dequest 2060S (as 100%) | 0.4 | 0.4 | 0.4 | 0.4 |
| Na-perborate tetrahydrate[3)] | 20 | 20 | — | 20 |
| Na-perborate monohydrate | — | — | 7.2 | — |
| Enzyme, Alcalase | 0.8 | 0.8 | 0.8 | 0.8 |
| $CaCl_2.2H_2O$ | 0.2 | 0.2 | 0.2 | 0.1 |
| Fluorescer, Tinopal CBSX | 0.1 | 0.1 | 0.1 | 0.1 |
| Silicon, Dow Corning DB100 | 0.3 | 0.3 | 0.3 | 0.3 |
| Perfume | 0.3 | 0.3 | 0.3 | 0.3 |
| deflocculating polymer[4)] | 1 | 1 | 1.1 | 1 |
| ethanol | — | — | — | 2.5 |
| water | | balance | | |
| pH | 9 | 9 | 9 | 9 |

[1)]This mixture is used to adjust the final pH
[2)]Expressed as % of analysed enzyme level in the frsh sample
[3)]as 100% perborate, added as a dispersion (Proxsol ex ICI, approximate 65% perborate dispersion in water with an average perborate particle size of 40 micrometer.
[4)]deflocculating polymer of formula I of EP 346 995, wherein x = 50, y = 0, $R^5$ = H, $R^6$ = $CH_3$, $R^1$ = —CO—O, $R^2$ and $R^3$ are absent, $R^4$ = —$C_{12}H_{25}$, mW = 7,500.
[5)]wt % -approximate- of total perborate, obtained by removal of the undissolved bleach particles by mild centrifugation.
[6)]not measured The obtained products had the following characteristics:

| | 5 | 6 | 7 | 8 |
|---|---|---|---|---|
| Volume stability (% volume increase, 3 months 25° C.) | 4 | 3 | 0 | n.m[6)] |
| clear layer separation (3 weeks 37° C.) | no | no | no | no |
| solid sedimentation (3 weeks 37° C.) | no | no | no | no |
| Viscosity 21 $s^{-1}$ | 1,350 | 710 | 800 | n.m |
| Viscosity $10^{-4}$ $s^{-1}$ | ≈200,000 | n.m | n.m | n.m |
| dissolved perborates[5)] | 3 | 1.5 | 8 | n.m |
| bleach activity % (2 months ambient T) | 99 | 99 | 96 | n.m |
| enzyme activity % (2 months ambient T)[2)] | 65 | 62 | 76 | n.m |

We claim:

1. An aqueous structured liquid detergent composition consisting essentially of detergent active materials and a soluble or partially soluble peroxygen bleach compound selected from the group consisting of hydrogen peroxide, peroxyacids, perborates, persulfates, peroxydisulfates, perphosphates and peroxyhydrates formed by reacting hydrogen peroxide with urea or alkali metal carbonate, said detergent composition having a pH between 6.5 and about 11 and showing less than 10% volume increase while stored at a temperature between 20° and 37° C. for three months after preparation.

2. An aqueous detergent composition according to claim 1, wherein the structure is formed by the detergent active materials.

3. An aqueous detergent composition according to claim 1, wherein the structure is formed by external structurants.

4. An aqueous detergent composition according to claim 1 having solid suspending properties.

5. An aqueous detergent composition according to claim 1, comprising less than a structure destabilizing amount of a water miscible solvent.

6. An aqueous detergent composition according to claim 1, wherein the composition further comprises an amount of electrolyte which is sufficiently high to effect that at least 30% by weight of the bleach is present in undissolved form.

7. A composition according to claim 6, wherein the amount of undissolved bleach is more than 50% by weight.

8. An aqueous detergent composition according to claim 1 comprising one or more stabilising agents for the bleach compound.

9. An aqueous detergent composition according to claim 1, comprising a bleach activator.

10. An aqueous detergent composition according to claim 1, having a viscosity at 21 $s^{-1}$ of between 20 and 1,000 mPas, and a viscosity at $10^{-4}$ $s^{-1}$ of more than 10,000 mPas.

11. An aqueous detergent composition according to claim 1 comprising 0.1 to 5.0% of a deflocculating polymer.

12. An aqueous detergent composition according to claim 1 comprising just after preparation less than 5.0% by volume of gas bubbles, said gas bubbles having an average diameter of more than 0.25 mm.

13. An aqueous detergent composition according to claim 1 comprising more than 0.2% by weight of an antifoam agent.

14. Method for the washing of fabrics, comprising the contacting of the fabrics with a wash liquor comprising from 0.1 to 10% of a detergent composition according to claim 1.

15. A composition according to claim 1, wherein the peroxyacid is diperoxydodecandioic acid (DPDA).

16. A composition according to claim 1, wherein the perborate is perboratetetrahydrate.

17. A composition according to claim 6, wherein the amount of undissolved bleach is more than 75% by weight.

18. A composition according to claim 1, wherein the volume increase is less than 5%.

19. A composition according to claim 5, wherein the amount of water miscible solvent is less than 10% by weight.

* * * * *